US006153037A

United States Patent [19]

Kim et al.

[11] Patent Number: 6,153,037

[45] Date of Patent: Nov. 28, 2000

[54] METHOD AND APPARATUS FOR PRODUCING MULTI-PLY CORRUGATED PAPERBOARD

[75] Inventors: Do Wook Kim, Seoul; Ki Jeong Kim, Kyungki-do, both of Rep. of Korea

[73] Assignee: Daeyoung Packaging Co., Ltd., Kyungki-do, Rep. of Korea

[21] Appl. No.: 08/750,491

[22] PCT Filed: Jul. 31, 1995

[86] PCT No.: PCT/KR95/00099

§ 371 Date: Dec. 11, 1996

§ 102(e) Date: Dec. 11, 1996

[87] PCT Pub. No.: WO96/32250

PCT Pub. Date: Oct. 17, 1996

[30] Foreign Application Priority Data

Apr. 11, 1995 [KR] Rep. of Korea ..... 95/8324

[51] Int. Cl.[7] ..... B31F 1/28

[52] U.S. Cl. ..... 156/205; 156/210; 156/292; 156/350; 156/361; 156/462; 156/471; 156/472; 156/473

[58] Field of Search ..... 156/205, 210, 156/471, 472, 473, 462, 292, 350, 361; 428/186, 179, 184, 185

[56] References Cited

U.S. PATENT DOCUMENTS

| | | | |
|---|---|---|---|
| 1,032,789 | 7/1912 | Swift, Jr. | 428/186 |
| 1,184,748 | 5/1916 | Hicks | 156/205 |
| 1,802,522 | 4/1931 | Moll | 428/186 |
| 1,802,880 | 4/1931 | Cumfer | 156/205 |
| 4,886,563 | 12/1989 | Bennett et al. | 156/205 |

*Primary Examiner*—Richard Crispino
*Attorney, Agent, or Firm*—Banner & Witcoff, Ltd.

[57] ABSTRACT

Method and apparatus for producing a multi-ply corrugated paperboard (105) by repeatedly laminating multi-ply corrugated mediums (102, 103) with different pitches and widths between top and bottom liners is disclosed. This invention thins the paperboard and improves the compressive strength of the paperboard so as to substantially reduce the package volume. In the process for producing the multi-ply corrugated paperboard, a first corrugated medium (102) is continuously laminated to a liner (101), thereby forming a single-ply paperboard. The first corrugated medium (102) has predetermined flute pitch and flute peak height. Thereafter, a second corrugated medium (103) is continuously laminated to the single-ply paperboard, thereby forming the multi-ply corrugated paperboard (105) having improved shock absorptivity and compressive strength against a vertical load. The second corrugated medium has optionally selected flute pitch and flute peak height.

16 Claims, 5 Drawing Sheets

METHOD AND APPARATUS FOR PRODUCING MULTI-PLY CORRUGATED PAPERBOARD

This application is a 35 U.S.C. 371 application of PCT/KR95/00099 filed Jul. 31, 1995.

TECHNICAL FIELD

The present invention relates in general to corrugated paperboard used for packaging various goods and, more-particularly, to an improvement in method and apparatus for producing multi-ply corrugated paperboards for orderly laminating multi-ply corrugated mediums between top and bottom liners of a multi-ply corrugated paperboard and thereby thinning the paperboard and improving the compressive strength of the paperboard to substantially reduce the package volume. The multi-ply corrugated paperboard produced by the method and apparatus of this invention effectively absorbs outside shock applied to the package and thereby protect the packaged goods from the shock.

BACKGROUND ART

As well known to those skilled in the art, various fragile goods needing to be handled with care, for example expensive bottled cosmetics, electronic and electric products such as television sets, are conventionally packaged using rigid boxes with shock-absorbing materials. The above shock-absorbing materials are used for absorbing the outside shock applied to the packaged goods and thereby protect the goods from the shock.

In the prior art, both expanded polystyrene formed according to the contours of the goods to be packaged and cardboard mounts folded into given shapes or partially cut out sufficient enough to hold the goods in the package boxes are generally used as shock-absorbing materials. When the goods to be packaged are heavy goods such as refrigerators, the packaging materials for such goods need to be provided with both excellent shock absorptivity and rigidity sufficient enough to absorb the outside shock and to bear the weight of the heavy goods. In order to achieve the above object, the package boxes for such heavy goods are preferably bottomed with wooden pallets.

The expanded polystyrene used as a shock-absorbing material has an advantage in that it is easily formed and suitable for mass production. However, the expanded polystyrene breaks easily and induces static electricity. Therefore, the expanded polystyrene not only causes environmental contamination due to its broken pieces, but also is scarcely used for packaging precision goods due to the static electricity. Otherwise stated, use of the expanded polystyrene as the shock-absorbing material is limited as it remarkably reduces the expected life of the packaged goods.

The cardboard mounts folded into given shapes or partially cut out sufficient enough to hold the goods in the package boxes are problematic in that they are not suitable for mass production. Furthermore, the above cardboard mounts have inferior durability and generate paper dust while packaging the goods. Due to the inferior durability as well as the paper dust, the above cardboard mounts may exert a bad influence upon the expected life of the packaged goods.

In order to rectify the above problems, package cases formed using pulp molds have been recently proposed and used. However, the above package cases need to be formed using individual molds even when the cases are produced on a small scale. As the molds should be produced by highly skilled workers one by one, the package cases are problematic in that it is very difficult to produce the cases. Another problem of the above package cases is that they are expensive.

As people are recently becoming environmentally conscious, used packaging materials need appropriate treating to prevent them from causing environmental contamination. However, it has been noted that treatment of various plastic packaging materials such as expanded polystyrene is very difficult as the above plastic packaging materials can not be recycled. The above plastic packaging materials will cause environmental contamination and exert a bad influence upon the ecosystem when they are simply discarded. Therefore, environmentally conscious people tend to avoid using such plastic packaging materials. Thus, demand for the above plastic packaging materials is reduced.

DISCLOSURE OF THE INVENTION

It is, therefore, an object of the present invention to provide method and apparatus for producing a structurally improved corrugated paperboard, the paperboard overcoming the above problems and having an improved structure suitable for not only reliably protecting the packaged goods, but also improving durability of the paperboard.

It is another object of the present invention to provide method and apparatus for producing a high value-added, multi-ply corrugated paperboard by repeatedly laminating multi-ply corrugated mediums with different pitches and widths between top and bottom liners of the paperboard and thereby thinning the paperboard and improving the compressive strength of the paperboard to substantially reduce the package volume.

It is a further object of the present invention to provide method and apparatus for producing a multi-ply corrugated paperboard, the paperboard being not made of different materials causing environmental contamination but exclusively made of recycled papers through an automatic process and thereby providing cheap shock absorbers having various configurations and suitable for recycling.

This invention provides a method for producing a multi-ply corrugated paperboard comprising the steps of: continuously laminating a first corrugated medium on a liner to form a single-ply paperboard, the first corrugated medium having predetermined flute pitch and flute peak height; and continuously laminating a second corrugated medium on the single-ply paperboard to form the multi-ply corrugated paperboard having improved shock absorptivity and compressive strength against a vertical load, the second corrugated medium having optionally selected flute pitch and flute peak height.

In an embodiment, the method comprises the steps of: guiding both a liner and two or more corrugated mediums (first and second corrugated mediums) to a first laminating station having first and second pairs of corrugator rollers; preheating the liner to a temperature sufficient enough to bond the corrugated mediums to the liner; guiding the first medium to the first pair of corrugator rollers to corrugate the first medium with predetermined flute pitch and flute peak height and in turn laminating the first corrugated medium to the preheated liner through bonding and thereby forming a single-faced, single-ply corrugated paperboard; guiding the second medium to the second pair of corrugator rollers to corrugate the second medium with optionally selected flute pitch and flute peak height and in turn laminating the second corrugated medium to the single-ply paperboard through bonding; pressing down the first and second corrugated mediums on the liner using a press belt and thereby forming a double-faced and multi-ply corrugated paperboard; guiding the multi-ply corrugated paperboard to a paper guider and controlling a paperboard feeding velocity by means of a suction brake; uniformly tensioning and, preheating the multi-ply corrugated paperboard; feeding a cover paper to the multi-ply corrugated paperboard passed from the paper guider such that the cover paper runs parallel to the bottom surface of the paperboard; continuously uniformly applying adhesive on the first and second corrugated mediums of the multi-ply corrugated paperboard as well as to the cover paper; and guiding the multi-ply corrugated paperboard as well as the cover paper applied with the adhesive to a heating plate and compressing the paperboard as well as the cover paper using a constant pressure while the paperboard and the cover paper pass over the heating plate and thereby forming a double-faced and multi-ply corrugated paperboard.

In another embodiment, the method may further comprise the step of laminating the multi-ply corrugated paperboard having the same structure to each other such that the corrugated mediums of the multi-ply corrugated paperboards either direct to the same or opposed directions.

The apparatus of this invention comprises: uncoiling drums for feeding both a liner and two or more corrugated mediums (first and second corrugated mediums) to single-faced corrugated paperboard laminating means; the laminating means supplied with the liner as well as the corrugated mediums unwound from the uncoiling drums and continuously laminating the corrugating mediums to the liner and thereby forming a single-faced and multi-ply corrugated paperboard, the laminating means having first and second pairs of corrugator rollers for continuously corrugating the first and second mediums with either the same or different flute pitches and predetermined flute peak heights; a paper guider provided at the exit from the laminating means to control the feeding velocity of the single-faced and multi-ply corrugated paperboard passed from the laminating means; a tension roll and preheating means provided at the exit from the paper guider to uniformly tension and preheat the single-faced and multiply corrugated paperboard passed from-the paper guider; a cover paper uncoiling drum provided at the entry to the preheating means to feed a cover paper to the single-faced and multi-ply corrugated paperboard passed from the paper guider such that the cover paper runs parallel to the bottom surface of the paperboard; adhesive applying means for continuously uniformly applying adhesive on the first and second corrugated mediums of the single-faced and multi-ply corrugated paperboard as well as to the cover paper; and a heating plate and a press belt for compressing the single-faced and multi-ply corrugated paperboard as well as the cover paper applied with the adhesive using a constant pressure and thereby forming a double-faced and multi-ply corrugated paperboard.

The laminating means further includes adhesive applying rollers placed about the first and second pairs of corrugator rollers to apply adhesive on the first and second corrugated mediums respectively; and biasing means for biasing the liner toward the corrugated mediums to bring the liner into close contact with the corrugated mediums, the biasing means comprising: a pair of belt drive rolls placed above the first and second pairs of corrugator rollers; a second press belt wrapped about the drive rolls; and a guide roll for guiding the second press belt to make the belt be partially wrapped about the upper corrugator rollers. The laminating means comprises first and second laminating stations placed aside and having the same structure. Otherwise stated, the first laminating station forms a first single-faced and multi-ply corrugated paperboard such that the corrugated mediums of the first paperboard are directed down, while the second laminating station forms a second single-faced and multiply corrugated paperboard such that the corrugated mediums of the second paperboard are directed up.

The paper guider provided at the exit from the laminating means includes a suction brake having a plurality of suction holes on its top surface, the suction brake being adjusted in its air suction strength under the control of a flute position sensor to make the corrugated mediums substantially meet with each other, the sensor being adapted for sensing the feeding velocity of the single-faced and multi-ply paperboard; and a suction blower connected to the suction brake to control air suction strength of the suction brake.

BRIEF DESCRIPTION OF DRAWINGS

The above and other objects, features and other advantages of the present invention will be more clearly understood from the following detailed description taken in conjunction with the accompanying drawings, in which:

FIGS. 5A to 5E are sectional views of corrugated paperboards formed according to the invention respectively, in which:

FIG. 5A shows a double-faced corrugated paperboard having a single-ply corrugated medium laminated to a liner and in turn laminated with a cover paper;

FIG. 5B shows a double-faced and double-ply corrugated paperboard having two corrugated mediums with the same flute pitch but different flute peak heights;

FIG. 5C shows a double-faced and double-ply corrugated paperboard having two corrugated mediums with the same flute pitch and flute peak height;

FIG. 5D shows a double-faced and double-ply corrugated paperboard having two corrugated mediums having different flute pitches; and FIG. 5E shows a double-faced and double-ply corrugated paperboard having two corrugated mediums with the same flute pitch and flute peak height.

BEST MODE FOR CARRYING OUT THE INVENTION

Figure 1A:
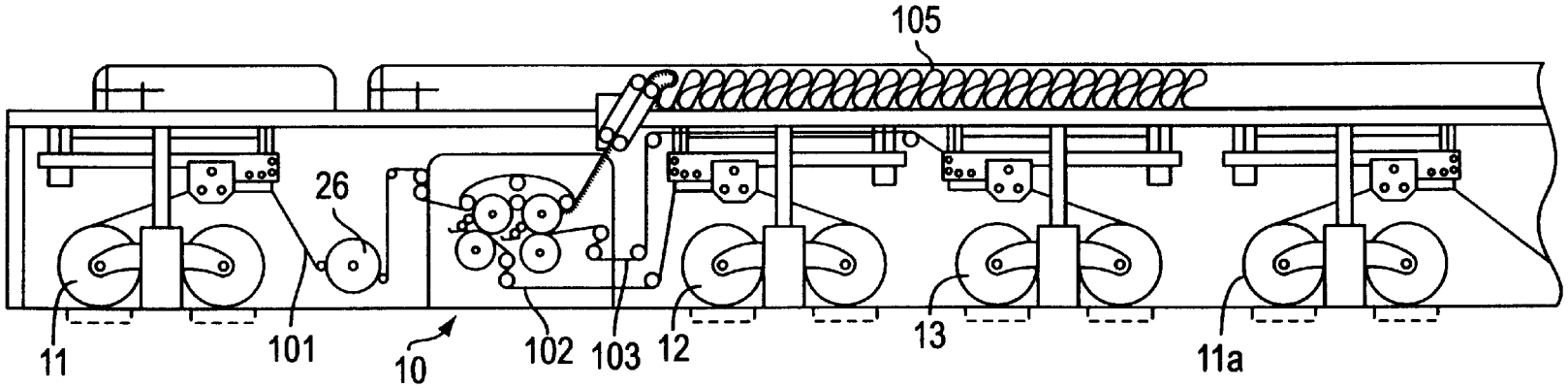
FIG. 1 is a view showing the construction of an apparatus for producing a multi-ply corrugated paperboard in accordance with a preferred embodiment of this invention.
Figure 1B:
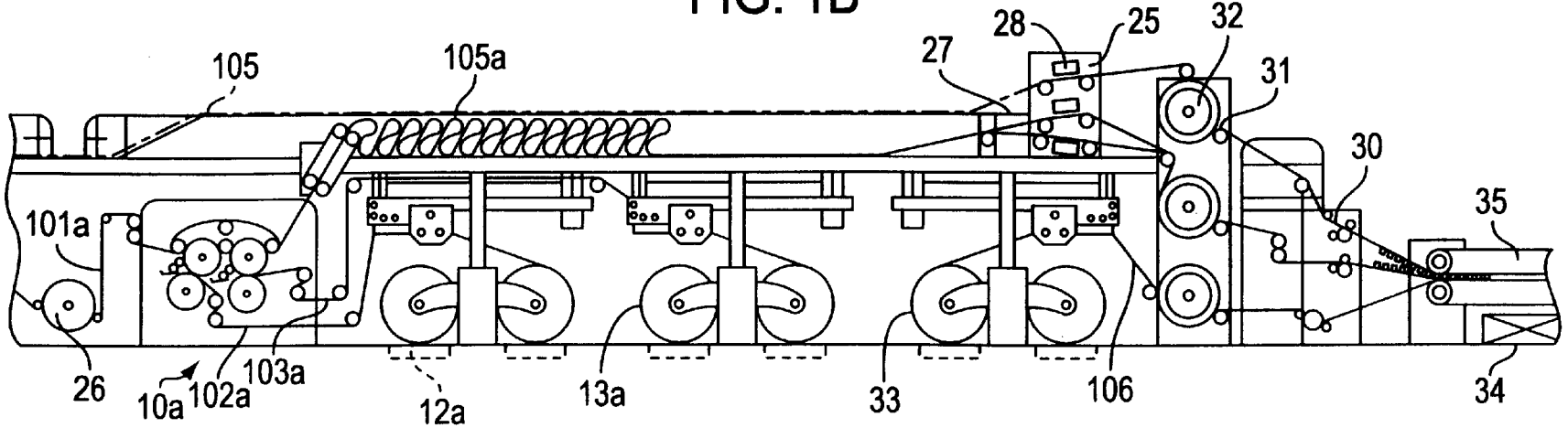
Figure 2:
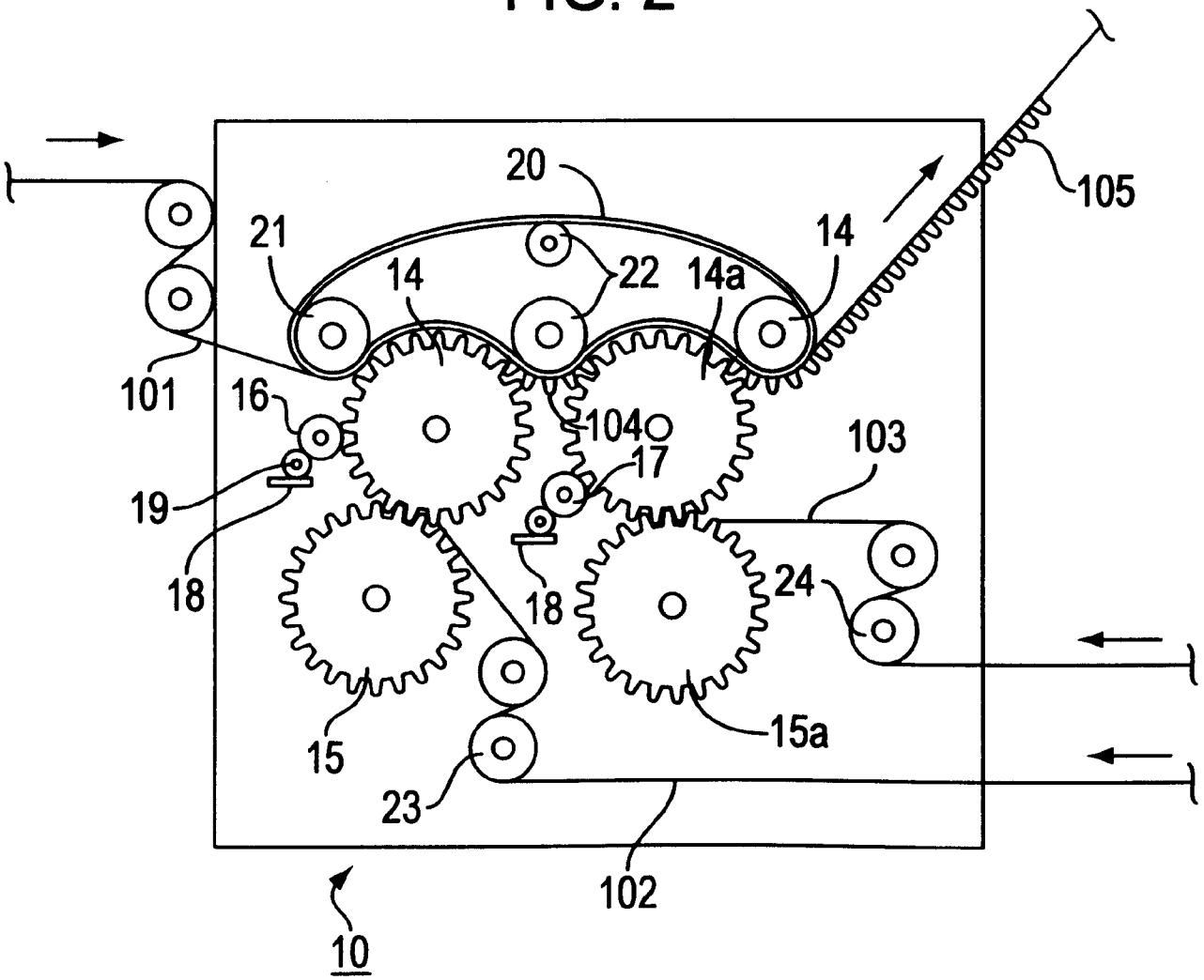
FIG. 2 is a view showing the construction of a first laminating station of the above apparatus for forming a single-faced corrugated paperboard.
Figure 3:
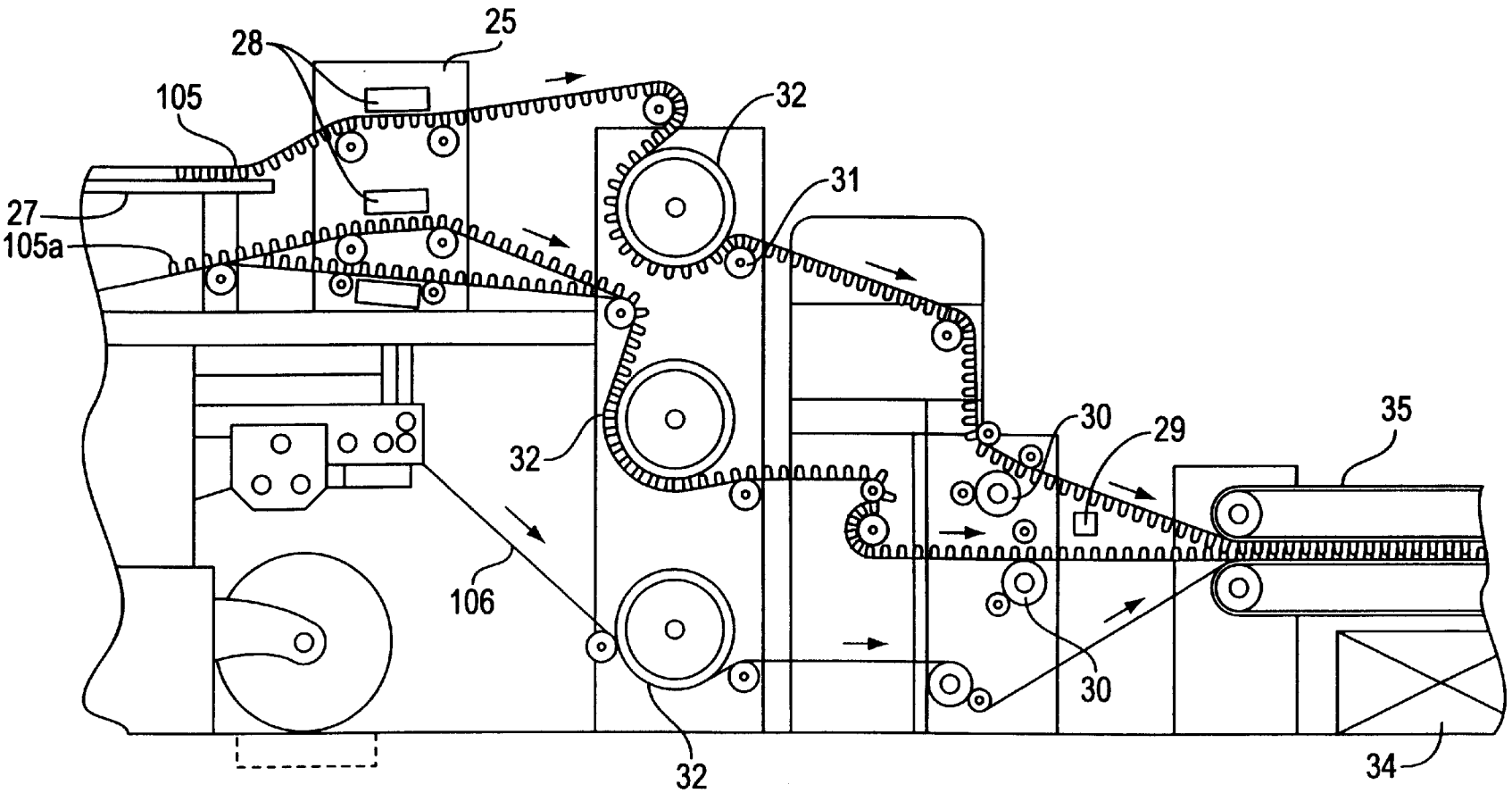
FIG. 3 is a view showing the construction of a cover paper laminating station provided at the exit from the above first laminating station.
Figure 4:
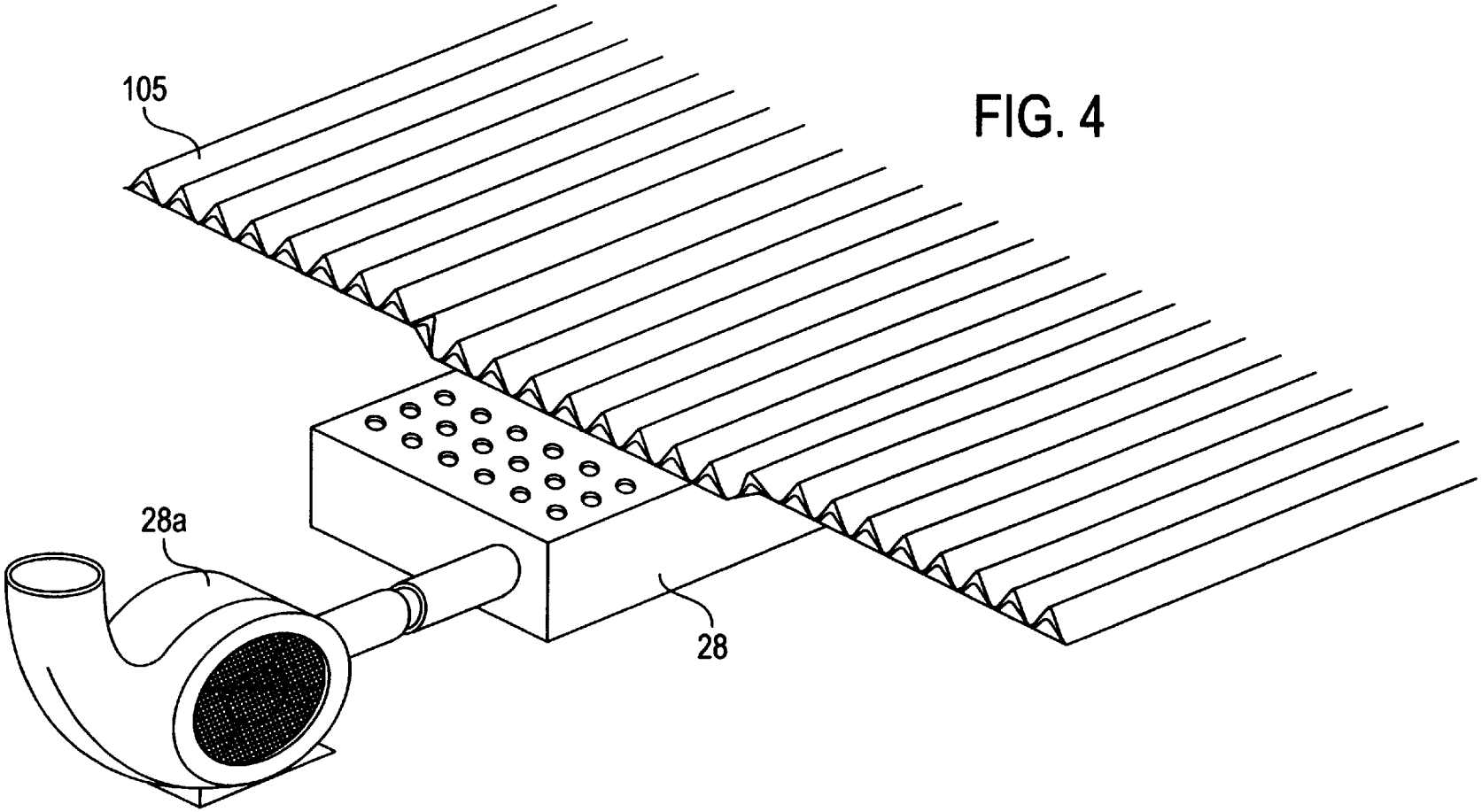
FIG. 4 is a perspective view showing the construction of a suction brake installed in a paper guider of the above cover paper laminating station.

FIG. 1 shows the construction of an apparatus for producing a multi-ply corrugated paperboard in accordance with a preferred embodiment of this invention. FIG. 2 shows the construction of a first laminating station of the above apparatus for forming a first single-faced corrugated paperboard. FIG. 3 shows the construction of a cover paper laminating station provided at the exit from the above first laminating station. FIG. 4 shows the construction of a suction brake installed in a paper guider of the above apparatus.

As shown in the above drawings, the multi-ply corrugated paperboard producing apparatus of this invention includes three pairs of uncoiling drums 11, 12 and 13. The first uncoiling drums 11 are for continuously unwinding a liner 101, while the second and third uncoiling drums 12 and 13 are for continuously unwinding two or more corrugated mediums 102 and 103. Both the liner 101 unwound from the first uncoiling drums 11 and the corrugated mediums 102 and 103 unwound from the second and third uncoiling drums 12 and 13 are passed over guide tension rollers and guided to a first laminating station 10 for forming a single-faced and multi-ply corrugated paperboard. The above first laminating station 10 includes at least two pairs of corrugator rollers 14 and 15, 14*a* and 15*a* for continuously corrugating the first and second corrugated mediums 102 and 103 with different flute pitches and flute peak heights respectively. In the first laminating station 10, the first corrugated medium 102 is continuously corrugated between the first pair of corrugator rollers 14 and 15, while the second corrugated medium 103 is continuously corrugated between the second pair of corrugator rollers 14*a* and 15*a*. The corrugated mediums 102 and 103 with different flute pitches and flute peak heights are, thereafter, continuously laminated to the liner 101 passed over the guide tension rollers to be guided to the first laminating station 10. The first laminating station 10 also includes adhesive applying means for applying adhesive on the first and second corrugated mediums 102 and 103. The adhesive applying means includes two adhesive applying rollers 16 and 17 which are placed about the upper corrugator rollers 14 and 14*a* and used for applying adhesive on the first and second corrugated mediums 102 and 103 respectively. In order to bias the liner 101 toward the corrugated mediums 102 and 103 to bring the liner 101 into close contact with the corrugated mediums 102 and 103, the first laminating station 10 further includes a biasing means. The biasing means comprises a pair of belt drive rolls 21 placed aside by the upper corrugator rollers 14 and 14*a* respectively. An endless press belt 20 is wrapped about the drive rolls 21 and driven by the rolls 21. The biasing means also includes a pair of guide rolls 22 for guiding the press belt 20 to make the belt 20 be partially wrapped about the upper corrugator rollers 14 and 14*a*.

The corrugated mediums 102 and 103 unwound from the uncoiling drums 12 and 13 are passed over the guide tension rolls 23 and 24 to be guided to the between the first pair of corrugator rollers 14 and 15 and to the between the second corrugator rollers 14*a* and 15*a* respectively.

Either first or second pair of corrugator rollers 14 and 15, 14*a* and 15*a* for continuously corrugating a medium 102 or 103 comprises upper and lower rollers which gear into each other to continuously corrugate the medium 102 or 103 and thereby form regularly corrugated medium. Both the flute pitch and the flute peak height of each corrugated medium 102, 103 may be freely changed as desired. The upper corrugator rollers 14 and 14*a* are meshing corrugator rollers provided with a plurality of suction holes (not shown) in the valleys of the rollers 14 and 14*a*. As the upper corrugator rollers 14 and 14*a* are meshing corrugator rollers, the corrugated mediums 102 and 103 passing between-the corrugator rollers 14 and 15, 14*a* and 15*a* can be brought into close contact with the valleys of the rollers 14 and 14*a* by the suction force generated by the suction holes. Therefore, the corrugator rollers 14 and 15, 14*a* and 15*a* continuously corrugate the mediums 102 and 103 into the desired corrugated configurations and let the corrugated mediums maintain in the corrugated configurations.

That is, the suction holes formed in the valleys of the meshing corrugator rollers 14 and 14*a* let the corrugated mediums 102 and 103 reliably maintain the corrugated configurations by the time when the mediums 102 and 103 are laminated to the liner 101. When the corrugated mediums 102 and 103 begins coming into contact with the liner 101, the suction force is not generated by the suction holes of the upper rollers 14 and 14*a* any more.

In the above first laminating station 10, it is preferred to form the corrugator rollers 14 and 15, 14*a* and 15*a* into cartridge type rollers suitable for changing existing rollers with other rollers having different corrugating pitches and corrugating heights. When cartridge type rollers are used as the corrugator rollers 14 and 15, 14*a* and 15*a*, it is not required to totally change the first laminating station 10 but to partially selectively change the corrugator rollers in order to continuously form various corrugated paperboards with different flute pitches and flute peak heights as shown in FIGS. 5A to 5E.

The adhesive applying means for uniformly applying adhesive on the first and second corrugated mediums 102 and 103 includes two adhesive applying rollers 16 and 17 which are placed about the upper corrugator rollers 14 and 14*a* and used for applying adhesive on the first and second corrugated mediums 102 and 103 respectively. The rollers 16 and 17 in turn are brought into contact with transition rollers 19 which are partially immersed in adhesive containers 18. As the transition rollers 19 are partially immersed in adhesive containers 18 charged with liquid adhesive, the liquid adhesive of the containers 18 is transmitted to the applying rollers 16 and 17 through the transition rollers 19 and in turn applied on the corrugated mediums 102 and 103.

However, it should be understood that the adhesive applying means may comprise an adhesive applying sheet with a series of adhesive spraying nozzles. In this case, the adhesive spraying nozzles may be selectively opened according to the configuration of the corrugated medium to be applied with the adhesive and thereby freely adjusting the width and range to be applied with the adhesive. Alternatively, an additional roller may be immersed in each adhesive container 18 and brought into contact with the transition roller 19 which in turn is brought into contact with the adhesive applying roller 16 or 17. In this case, the liquid adhesive in each container 18 is transmitted to the applying roller 16 or 17 through the additional roller and the transition roller 19 and in turn evenly applied on the corrugated medium 102 or 103 in a uniform thickness.

Meanwhile, the belt drive rolls 21 of the biasing means cooperate with the first and second corrugator rollers 14 and 15, 14*a* and. 15*a* through power transmission gears with the same rotating velocity. The above power transmission gears having the same rotating velocity make either the liner 101 guided to the corrugator rollers 14 and 15, 14*a* and 15*a* or a single-faced, single-ply corrugated paperboard 104 at the exit from the first pair of corrugator rollers 14 and 15 be fed at a constant velocity.

However, it should be understood that the relation between the corrugator rollers 14 and 15, 14*a* and 15*a* and the belt drive rolls 21 may be formed as follows while considering an operational error caused by slip of the press belt 20. That is, the first and second pairs of corrugator rollers 14 and 15, 14*a* and 15*a* are connected to each other by means of transmission gears, while the belt drive rolls 21 are connected to an output shaft of a drive motor. In this case, the belt drive motors 21 are independently controlled in accordance with the rotating velocity of the first and second pairs of corrugator rollers 14 and 15, 14*a* and 15*a*.

As described above, the corrugated mediums 102 and 103 in the first laminating station 10 are continuously laminated to the liner 101 and thereby forming the single-faced and double-ply corrugated paperboard 105. In order to control the feeding velocity for the paperboard 105, a paper guider 25 is provided at the exit from the first laminating station 10.

At the entry to the first laminating station 10, preheating means 26 for heating the liner 101 to a temperature sufficient enough to bond the corrugated mediums 102 and 103 to the liner 101. A second laminating station 10*a* having the same structure as the first laminating station 10 is placed at the exit from the first laminating station 10 as shown in FIG. 1. As the paper guider 25 is installed at the exit from the first laminating station 10 as shown in FIG. 1, the single-faced and double-ply corrugated paperboard 105 formed by the first laminating station 10 is passed over a bridge 27 and in turn guided to the paper guider 25. The second laminating station 10*a* installed at the exit from the first laminating station 10 has a pair of uncoiling drums 11*a* for unwinding a liner 101*a* and two pairs of uncoiling drums 12*a* and 13*a* for unwinding corrugated mediums 102*a* and 103*a*. Therefore, the second laminating station 10*a* forms a second single-faced and double-ply corrugated paperboard 105*a* which will be laminated to the paperboard 105 as will be described later herein and thereby forming a double-faced and double-ply corrugated paperboard.

The second single-faced and double-ply corrugated paperboard 105*a* is formed by continuously laminating the corrugated mediums 102*a* and 103*a* to the liner 101*a* in the same manner as described for the first laminating station 10. Of course, it should be understood that the liner 101*a* is passed over the preheating means 26 at the entry to the second laminating station 10*a* and thereby being heated to a temperature sufficient enough to bond the corrugated mediums 102*a* and 103*a* to the liner 101*a*.

The single-faced and double-ply corrugated paperboards 105 and 105*a* formed by the first and second laminating stations 10 and 10*a* are in turn guided to the paper guider 25. As the paper guider 25 is provided with a suction brake 28, the paper guider 25 effectively controls the feeding velocity of the paperboards 105 and 105*a* using the suction brake 28. As shown in FIG. 4, the suction brake 28 is provided with a plurality of suction holes on its top surface and connected to a suction blower 28*a* which controls the air suction strength of the suction brake 28.

The above suction brake 28 of the paper guider 25 performs a very important function when the corrugated paperboards 105 and 105*a* formed by the first and second laminating stations 10 and 10*a* are laminated to each other and thereby form a double-faced and double-ply corrugated paperboard which will be described later herein. When forming the double-faced and double-ply corrugated paperboard, the corrugated paperboards 105 and 105*a* will be bonded to each other under the condition that the flutes of the corrugated mediums 102 and 103 of the paperboards 105 and 105*a* are checked one by one by a flute sensor 29 which will be described later herein.

That is, the flute sensor 29 precisely senses the flute position of the corrugated paperboard 105 having the corrugated mediums 102 and 103 when the paperboard 105 passes between adhesive applying means 31 and a biasing belt 35. The flute sensor 29 in turn precisely controls the suction brake 28 and thereby making the flutes of the corrugated paperboard 105 formed by the first laminating station 10 substantially meet with the flutes of the corrugated paperboard 105*a* formed by the second laminating station 10*a*.

A plurality of tension rolls 31 and preheating means 32 are installed at the exit from the paper guider 25 as best seen in FIG. 3. The above tension rolls 31 as well as the preheating means 32 sufficiently tension and heat the corrugated paperboards 105 and 105*a* passed from the first and second laminating stations 10 and 10*a* and a cover paper 106 continuously passed from a pair of cover paper uncoiling drums 33 respectively. The tension rolls 31 and the preheating means 32 guide the corrugated paperboards 105 and 105*a* and the cover paper 106 to the adhesive applying means 30. The adhesive applying means 30 continuously applies the predetermined amount of adhesive to the paperboards 105 and 105*a* and to the cover paper 106 and in turn guides the paperboards 105 and 105*a* as well as the cover paper 106 between a heating plate 34 and the press belt 35. Between a heating plate 34 and the press belt 35, the single-faced and double ply corrugated paperboards 105 and 105*a* and the cover paper 106, both being applied with the adhesive, are compressed using a constant pressure to be laminated to each other, thereby forming a double-faced and double-ply corrugated paperboard with good quality.

The method for producing a multi-ply corrugated paperboard using the above apparatus will be described hereinafter.

In the first laminating station 10 of the corrugated paperboard producing device of this invention, the first corrugated medium 102 with predetermined flute pitch and flute peak height and the second corrugated medium 103 with optionally selected flute pitch and flute peak height are continuously laminated to the liner 101. The first laminating station 10 thus form the single-faced and double-ply corrugated paperboard 105 with improved shock absorptivity and compressive strength against vertical load.

In addition, the above corrugated paperboards 105 are laminated to each other and thereby forming various double-faced and double-ply corrugated paperboards suitable for used as improved shock-absorbing materials. In this case, the paperboards 105 may be arranged such that the corrugated mediums 102 and 103 of the paperboards 105 either direct to the same or opposed directions.

If described in detail, the liner 101 and at least two corrugated mediums 102 and 103 are unwounded from their associated uncoiling drums 11, 12 and 13 and passed over tension guide rollers to be guided to the first laminating station 10 with the corrugator rollers 14 and 15 and 14*a* and 15*a*. At the entry to the first laminating station 10, the liner 101 is heated to a temperature sufficient enough to rigidly bond the corrugated mediums 102 and 103 to the heated liner 101. The first corrugated medium 102 unwounded from the drums 12 is corrugated between the first pair of corrugator rollers 14 and 15 into predetermined flute pitch and flute peak height. The first medium 102 in turn is continuously laminated to the preheated liner 101 to form a single-faced, single-ply corrugated paperboard 104 as shown in FIG. 2. The single-faced, single-ply corrugated paperboard 104 in turn is guided to the second pair of corrugator rollers 14*a* and 15*a*. The second pair of corrugator rollers 14*a* and 15*a* continuously corrugate the second medium 103 passed from the drums 13 and laminate the second medium 103 to the paperboard 104 and thereby forming a single-faced and double-ply corrugated paperboard 105. In this case, the liner 101 and the corrugated mediums 102 and 103 are compressed by the press belt 20 to be brought into close contact with each other. Therefore, the liner 101 and the corrugated mediums 102 and 103 are easily laminated to each other.

The single-faced and double-ply corrugated paperboard 105 having the corrugated mediums 102 and 103 in turn is passed from the first laminating station to the paper guider 25. In the paper guider 25, the feeding velocity of the paperboard 105 is optimally controlled by the suction brake 28 of the guider 25. The paperboard 105 in turn is sufficiently tensioned and heated by the tension roll 31 and the preheating means 32 installed at the exit from the paper guider 25.

At this time, the cover paper 106 unwound from the drums 33 is guided to the between the heat plate 34 and the biasing belt 35 such that the cover paper 106 runs parallel to the bottom surface of the paperboard 105. As the adhesive applying means 30 is placed between the tension rolls 31 and the biasing belt 35, the corrugated mediums 102 and 103 of the paperboard 105 as well as the cover paper 106 are continuously uniformly applied with adhesive.

When the paperboard 105 as well as the cover paper 106 has been guided to the between the heating plate 34 and the press belt 35, the corrugated paperboard 105 and the cover paper 106, both being applied with the adhesive, are compressed using a constant pressure to be laminated to each other, thereby forming a double-faced and double-ply corrugated paperboard with good quality.

While corrugating the mediums 102 and 103 by the corrugator rollers 14 and 15, 14*a* and 15*a* in the first laminating station 10, it is required to bring the mediums 102 and 103 into close contact with the corrugated contours of the upper rollers 14 and 14*a* and to give desired flutes to the mediums 102 and 103. In order to achieve the above object, the valleys of the corrugated contours of the upper rollers 14 and 14*a* are provided with suction holes (not shown) The upper corrugator rollers 14 and 14*a* are meshing corrugator rollers provided with a plurality of suction holes (not shown) generating suction force. Therefore, the corrugator rollers 14 and 15, 14*a* and 15*a* continuously corrugate the mediums 102 and 103 into the desired corrugated configurations and let the corrugated mediums maintain in the corrugated configurations. That is, the corrugated mediums 102 and 103 reliably maintain the corrugated configurations by the time when the mediums 102 and 103 are laminated to the liner 101. When the corrugated mediums 102 and 103 begins coming into contact with the liner 101, the suction force is not generated by the suction holes of the upper rollers 14 and 14*a* any more.

In order to control the paperboard feeding velocity using the suction brake 28 of the paper guider 25, the flutes of the paperboards 105 and 105*a* to be laminated to each other and form a double-faced and double-ply corrugated paperboard is sensed by the flute sensor 29. When the flutes of the paperboard 105 diverge from the flutes of the paperboard 105*a* such that the flutes of the paperboards 105 and 105*a* do not meet with each other, the sensor 29 outputs a signal to control the air suction strength of the brake 28. The feeding velocities of the paperboards 105 and 105*a* are thus controlled to be identified and thereby making the flutes of the paperboards 105 and 105*a* substantially meet with each other when laminating the paperboards 105 and 105*a* to each other and forming the double-faced and double-ply corrugated paperboard.

As described above, the first single-faced and doubly-ply corrugated paperboard 105 is formed by continuously corrugating the first and second corrugated mediums 102 and 103 unwound from the uncoiling drums 12 and 13 using the corrugator rollers and in turn continuously laminating the corrugated mediums 102 and 103 with different flute pitches and flute peak heights to the preheated liner 101 unwound from the uncoiling drums 11. When laminating the mediums 102 and 103 to the liner 101, the liner 101 is biased toward the corrugated mediums 102 and 103 by the press belt 20 to be brought into close contact with the corrugated mediums 102 and 103. Therefore, the first and second mediums 102 and 103 are rigidly laminated to the liner 101 in the single-faced and double-ply corrugated paperboard 105.

The above press belt 20 is wrapped about the pair of belt drive rolls 21 placed aside by the upper corrugator rollers 14 and 14*a* respectively. Additionally, the belt 20 is partially elastically wrapped about the upper corrugator rollers 14 and 14*a*. Therefore, the belt 20 effectively prevents a press roll mark from being formed on the corrugated paperboard 105.

The apparatus also includes the second laminating station 10*a* which is provided with the same structure as the first laminating station 10 and placed at the exit from the first laminating station 10. The second laminating station 10*a* forms the second single-faced and double-ply corrugated paperboard 105*a* which will be laminated to the first paperboard 105 formed by the first laminating station 10 to form a double-faced and double-ply corrugated paperboard with improved shock absorptivity.

The method and apparatus of this invention provide various corrugated paperboards as shown in FIGS. 5A to 5E.

Please noted that, when setting the sizes of the corrugator rollers 14 and 15, 14*a* and 15*a* of the first and second laminating stations 10 and 10*a*, the pitch ratio of the flutes of the lower corrugated medium to the flutes of the upper corrugated medium of a double-faced corrugated paperboard to be formed should be set in accordance with the target shock absorptivity and durability of the corrugated paperboard.

Figure 5A:
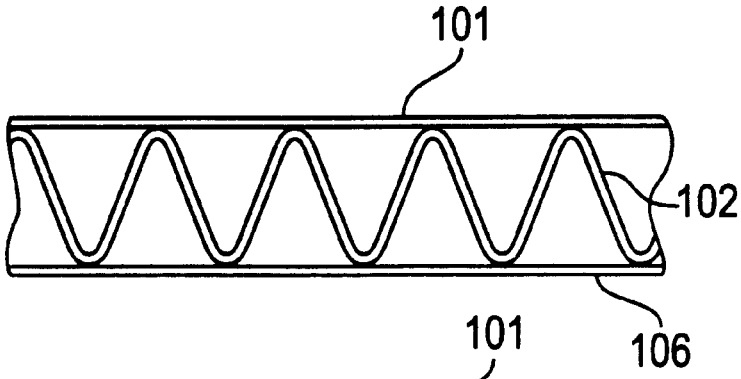

When either the first laminating station 10 is operated and, at the same time, either pair of corrugator rollers 14 and 15, 14*a* and 15*a* are operated, the apparatus of this invention will produce a conventional double-faced corrugated paperboard. This paperboard has a single-ply corrugated medium 102 laminated to the liner 101 and in turn laminated with the cover paper 106 as shown in FIG. 5A.

However, when both the first and second laminating stations 10 and 10*a* are operated while changing the corrugator rollers 14 and 15, 14*a* and 15*a*, the apparatus will form various types of double-faced and double-ply corrugated paperboards as shown in FIGS. 5B to 5E.

Figure 5B:
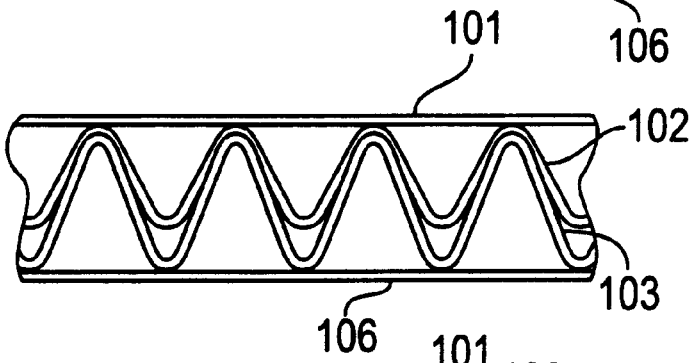

That is, FIG. 5B shows a double-faced and double-ply corrugated paperboard which has the two corrugated mediums 102 and 103 with the same flute pitch but different flute peak heights. In order to form the above paperboard, the two pairs of corrugator rollers 14 and 15, 14*a* and 15*a* of either laminating station 10 or 10*a* are selected to have the pitch ratio 1:1 of the corrugated rollers. In this case, it is required to continuously laminate the first corrugated medium 102 with a flute pitch to the liner 101 at first. Thereafter, the second corrugated medium 103 whose flute pitch is same with that of the first medium 102 but whose flute peak height differs from that of the medium 102 is continuously laminated to the single-ply corrugated paperboard having the medium 102 and thereby forming a double-ply corrugated paperboard. Thereafter, the cover paper 106 is laminated to the double-ply corrugated paperboard and thereby forming double-faced and double-ply corrugated paperboard.

In the above double-faced and double-ply corrugated paperboards, a plurality of chambers are defined between the corrugated mediums 102 and 103 due to the flute peak height difference between the two mediums 102 and 103. The above chambers defined between the two mediums 102 and 103 primarily absorb the outside shock applied to the package and thereby protect the packaged goods from the shock. When the outside shock is large such that the above spaces can not completely bear the shock, the surplus shock will be secondarily absorbed by the lower corrugated medium 102 and prevented from exerting a bad influence to the packaged goods.

Figure 5C:
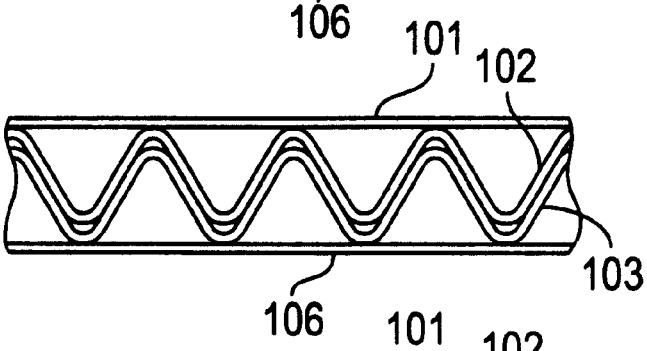

FIG. 5C shows a double-faced and double-ply corrugated paperboard with desired strength and shock absorptivity which has the two corrugated mediums 102 and 103 with the same flute pitch and flute peak height. In order to form the above paperboard, the first and second corrugated mediums 102 and 103 are corrugated such that the mediums 102 and 103 have the same flute pitch and flute peak height. However, the curvatures of the mediums 102 and 103 at the peaks of the flutes differ from each other and thereby continuously forming shock-absorbing chambers between the first and second mediums 102 and 103 laminated to the liner 101. Due to the irregular curvatures of the corrugated mediums 102 and 103, the above paperboard has various shock-absorbing effect according to configurations and flute peak heights of the corrugated mediums 102 and 103.

Figure 5D:
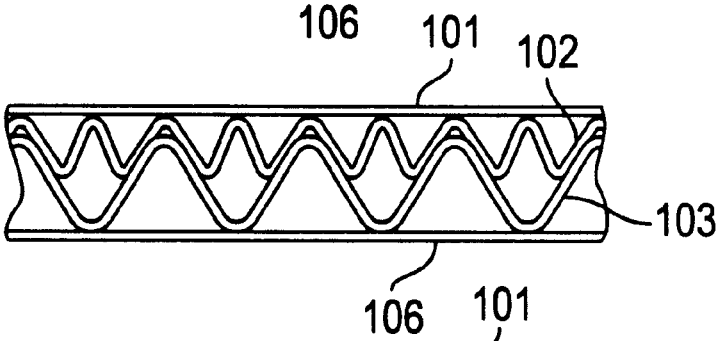

The double-faced and double-ply corrugated paperboard shown in FIG. 5D has the two corrugated mediums 102 and 103, the medium 103 has a longer flute pitch which is two times of that of the other medium 102. In order to form the above paperboard, the corrugator rollers 14 and 15, 14*a* and 15*a* of either laminating station 10 or 10*a* have different flute sizes. After the first medium 102 with smaller flute pitch is continuously laminated to the liner 101, the second medium 103 with longer flute pitch is continuously laminated to the single-ply corrugated paperboard with the first medium 102 and thereby forming a double-ply corrugated paperboard. Thereafter, the cover paper 106 is laminated to the above double-ply corrugated paperboard to form the double-faced and double-ply corrugated paperboard.

As the above corrugated paperboard has two corrugated mediums 102 and 103 with different flute pitches, the flutes of the medium 103 with longer pitch will be rushed into the flutes of the medium 102 with shorter pitch when the paperboard is applied with outside shock. In addition, two flutes of the medium 102 are rushed into the flutes of the medium 103. When the outside load is removed from the paperboard before the paperboard reaches its elastic limit, the deformed mediums restore original shapes respectively and thereby keeps the shock absorptivities irrespective of application of the outside shock.

Figure 5E:
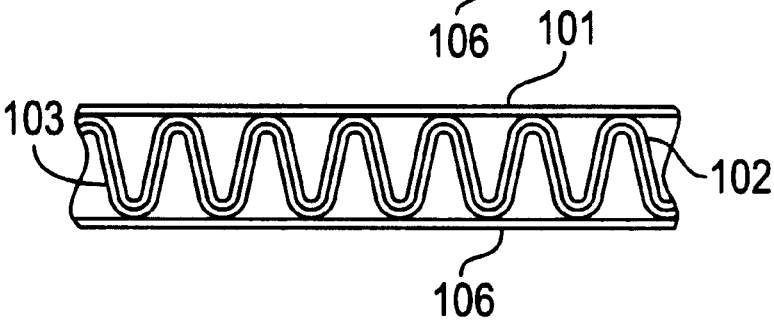

The double-faced and double-ply corrugated paperboard shown in FIG. 5E has the two corrugated mediums 102 and 103 with the same flute pitch and flute peak height. The two mediums 102 and 103 are brought into close contact with each other thoroughly. This paperboard improves shock absorptivity, compressive strength against vertical load and bending strength.

Of course, it should be understood that the above corrugated paperboards may be laminated to each other and thereby forming various corrugated paperboards suitable for used as improved shock-absorbing materials. In this case, the paperboards may be arranged such that the corrugated mediums 102 and 103 of the paperboards either direct to the same or opposed directions. The above paperboards will have various shock absorptivities in accordance with the flute configurations of the corrugated mediums and the flute peak heights.

INDUSTRIAL APPLICABILITY

As described above, the present invention provides method and apparatus for producing a multi-ply corrugated paperboard suitable for used as a shock-absorbing package material. In the above multi-ply corrugated paperboard, at least two corrugated mediums are continuously laminated to a liner and in turn laminated with a cover paper. As the above paperboard has two corrugated mediums, one corrugated medium can still keep the elasticity and shock absorptivity even when the other corrugated medium is depressed by the outside shock applied to the paperboard. Therefore, the multi-ply paperboard produced by this invention has improved durability and strength due to the corrugated mediums besides the shock absorptivity which is the intrinsic characteristic of paper. As the above multi-ply paperboard is light, it is very easy to handle in comparison with the conventional wooden or plastic heavy pallets. Due to the lightness of the paperboard, the paperboard also prevents possible safety accident caused by careless handling.

The multi-ply corrugated paperboard produced by this invention has at least two corrugated mediums which are continuously laminated to the liner and in turn laminated with the cover paper. Therefore, the invention thins the corrugated paperboard and improves the compressive strength of the paperboard to substantially reduce the package volume and thereby provides a high value-added corrugated paperboard. The invention thus provides a high strength and high value-added shock absorber with substantially low cost. As this paperboard can be easily recycled and used as a shock-absorbing package material instead of the expanded polystyrene, the paperboard does not cause environmental contamination but does much for saving resources. Furthermore, the multi-ply paperboard produced by this invention can effectively absorb outside shock applied to packaged goods and thereby reliably protect the packaged goods from the shock.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

We claim:

1. A method for producing a double-faced multi-ply corrugated paperboard comprising the steps of:

continuously laminating a first corrugated medium to a liner to form a single-faced single-ply paperboard with a corrugated surface, said first corrugated medium having predetermined flute pitch and flute peak height; and continuously laminating at least one second corrugated medium to said corrugated surface of said single-faced single-ply paperboard to form a single-faced multi-ply corrugated paperboard with a corrugated surface, said second corrugated medium having selected flute pitch and flute peak height which are either the same or different from the flute pitch and flute peak height of the first corrugated medium, respectively; and continuously laminating a cover paper to said corrugated surface of said single-faced multi-ply corrugated paperboard to form a double-faced multi-ply corrugated paperboard.

2. The method according to claim 1, further comprising the step of:

laminating together at least two layers of multi-ply corrugated paperboard having the same structure.

3. A method for producing a multi-ply corrugated paperboard comprising the steps of:

guiding both a liner and first and second webs to a first laminating station having first and second pairs of corrugator rollers;

preheating the liner to a temperature sufficient to bond a web to the liner;

guiding the first web to the first pair of corrugator rollers to corrugate the first web with predetermined flute pitch and flute peak height and in turn laminating the first web to the preheated liner through bonding and thereby forming a single-faced, single-ply corrugated paperboard;

guiding the second web to the second pair of corrugator rollers to corrugate the second web with selected flute pitch and flute peak height and in turn laminating the second web to said single-ply paperboard through bonding;

pressing down the first and second webs on the liner using a press belt and thereby forming a single-faced and multi-ply corrugated paperboard;

guiding said multi-ply corrugated paperboard to a paper guider and controlling a paperboard feeding velocity by means of a suction brake;

uniformly tensioning and preheating said multi-ply corrugated paperboard;

feeding a cover paper to the multi-ply corrugated paperboard passed from the paper guider such that the cover paper runs parallel to a bottom surface of said paperboard;

uniformly applying adhesive on said multi-ply corrugated paperboard as well as to the cover paper; and guiding the multi-ply corrugated paperboard as well as the cover paper with adhesive to a heating plate and compressing the paperboard as well as the cover paper using a constant pressure while the paperboard and the cover paper pass over the heating plate to thereby form a double-faced and multi-ply corrugated paperboard.

4. The method according to claim 3, wherein the first and second webs are brought into close contact with corrugated contours of upper rollers of their associated corrugator roller pairs by suction force generated from suction holes formed in the upper rollers in the steps of corrugating the first and second webs and thereby providing the first and second webs with desired corrugated configurations.

5. The method according to claim 3, wherein a flute sensor senses the flute position of said single-faced multi-ply corrugated paperboard and controls the suction brake to control the air suction strength of said brake when the flutes of the single-faced multi-ply corrugated paperboard diverge from the flutes of another corrugated paperboard and thereby identifying the paperboard feeding velocity and making the flutes of the paperboards substantially meet with each other.

6. An apparatus for producing a double-faced multi-ply corrugated paperboard comprising:

uncoiling drums for feeding a liner and at least two webs to single-faced corrugated paperboard laminating means;

said laminating means having at least first and second pairs of corrugator rollers for guiding and continuously corrugating the webs with either the same or different flute pitches and flute peak heights, each said pair of corrugator rollers including an upper roller and a lower roller, and biasing means for biasing the liner toward a first web to continuously laminate the liner to the first web to form a single-faced single-ply corrugated paperboard and for biasing the single-faced single-ply corrugated paperboard toward a second web to continuously laminate the second web to the single-faced single-ply corrugated paperboard to form a single-faced multi-ply corrugated paperboard; and cover paper laminating means for laminating a cover paper to the single-faced multi-ply corrugated paperboard to thereby form a double-faced multi-ply corrugated paperboard.

7. The apparatus according to claim 6, wherein said laminating means further includes:

adhesive applying rollers placed about the first and second pairs of corrugator rollers to apply adhesive on the first and second webs respectively; and biasing means for biasing the liner toward the corrugated mediums to bring the liner into close contact with the webs, said biasing means comprising;

a pair of belt drive rolls placed above the first and second pairs of corrugator rollers;

a second press belt wrapped about the drive rolls; and a guide roll for guiding the second press belt to make the belt be partially wrapped about the upper corrugator rollers.

8. The apparatus according to claim 6, wherein said laminating means comprises first and second laminating stations placed aside and having the same structure.

9. The apparatus according to claim 8, wherein said first laminating station forms a first single-faced and multi-ply corrugated paperboard such that the corrugated mediums of the first paperboard are directed down, while said second laminating station forms a second single-faced and multi-ply corrugated paperboard such that the corrugated mediums of the second paperboard are directed up.

10. The apparatus according to claim 8, wherein the paper guider provided at the exit from the laminating means includes:

a suction brake having a plurality of suction holes on its top surface, said suction brake being adjusted in its air suction strength under the control of a flute position sensor to make the corrugated mediums substantially meet with each other, said sensor being adapted for sensing the feeding velocity of the single-faced and multi-ply paperboard; and a suction blower connected to said suction brake to control air suction strength of the suction brake.

11. An apparatus for producing a multi-ply corrugated paperboard comprising:

uncoiling drums for feeding a liner and at least two webs to corrugator rollers;

at least two pair of corrugator rollers for guiding and continuously corrugating the webs, each pair including an upper roller and a lower roller;

adhesive applying rollers placed about the corrugator rollers to apply adhesive on the webs; and biasing means for biasing the liner toward the webs to bring the liner into close contact with the webs, said biasing means comprising;

a pair of belt drive rolls placed above the corrugator rollers;

a press belt wrapped about the drive rolls; and a guide roll for guiding the press belt to partially wrap the press belt about the upper rollers.

12. The apparatus according to claim 11, wherein the upper rollers are provided with a plurality of suction holes to bring the webs into close contact with corrugated contours of the upper rollers and thereby providing the webs with desired corrugated configurations.

13. The apparatus according to claim 11, wherein said corrugator rollers are cartridge type rollers suitable for changing existing rollers with other rollers having different corrugating pitches and corrugating heights.

14. The apparatus according to claim 11, wherein the liner and the webs unwound from the uncoiling drums are guided by their associated guide tension rollers to be appropriately tensioned.

15. The apparatus according to claim 11, wherein the belt drive rolls and the corrugated rollers are connected to each other by means of gears to ensure uniform feeding velocities of the liner and webs guided to the corrugator rollers and to precisely bond the flutes of the webs to each other.

16. The apparatus according to claim 11, wherein the belt drive rolls cooperate with a drive motor to compensate for an operational error caused by slip of the press belt, said belt drive rolls being independently controlled in accordance with the rotating velocity of the corrugator rollers.

* * * * *